US006523523B2

(12) United States Patent
McCoy et al.

(10) Patent No.: US 6,523,523 B2
(45) Date of Patent: Feb. 25, 2003

(54) CAMLESS ENGINE WITH CRANKSHAFT POSITION FEEDBACK

(75) Inventors: John C. McCoy, Fayetteville, TN (US); Larry Hiltunen, Rochester Hills, MI (US); Piero Caporuscio, Shelby Township, MI (US); Herbert Lacher, Leibfling (DE)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 62 days.

(21) Appl. No.: 09/838,791

(22) Filed: Apr. 20, 2001

(65) Prior Publication Data

US 2002/0056438 A1 May 16, 2002

Related U.S. Application Data

(60) Provisional application No. 60/249,478, filed on Nov. 13, 2000.

(51) Int. Cl.[7] ..... F02M 51/00

(52) U.S. Cl. ..... 123/406.58; 123/494

(58) Field of Search ..... 123/406.58, 406.59, 123/406.6, 612, 617; 73/117.3, 116, 118.1; 701/110; 324/390, 391, 392

(56) References Cited

U.S. PATENT DOCUMENTS 4,989,448 A * 2/1991 Fukui et al. ..... 701/101
5,196,844 A * 3/1993 Tomisawa et al. ..... 324/207.25
5,201,296 A 4/1993 Wunning
5,562,082 A * 10/1996 Norppa et al. ..... 123/406.53
5,703,283 A * 12/1997 McClish et al. ..... 701/110
5,970,784 A * 10/1999 Genin ..... 340/441
6,092,495 A 7/2000 Hackett

FOREIGN PATENT DOCUMENTS

DE 43 13 331 A1 10/1994
EP 0 724 067 A1 7/1996
EP 1 065 349 A2 1/2001

OTHER PUBLICATIONS

International Search Report, dated Jun. 4, 2002.

* cited by examiner

*Primary Examiner*—Willis R. Wolfe
*Assistant Examiner*—Mahmoud Gimie

(57) ABSTRACT

A control for a camless engine is provided with a plurality of modules each associated with an individual cylinder. The modules are programmed to operate their respective cylinders once on each of two revolutions of a crankshaft. Thus, the control modules must have an indication of the point in the rotational cycle of the crankcase, but also a signal of which of the two revolutions in the two-revolution cycle is ongoing for the crankshaft. The crankshaft preferably provides a uniform signal for each of the two revolutions. The uniform signal is modified by a signal modification method such that the signal sent to the modules is distinct for each of the two revolutions. In a preferred embodiment the signal is provided with a space which is indicative of a particular point in each revolution. A modifier is controlled by a switch which alternates between one of two positions, and which modifies the space in one of the two positions. In another embodiment at least a portion of the signal is inverted between the two revolutions. In yet another embodiment, the pulse width of at least a portion of the signal is changed between the two revolutions.

12 Claims, 1 Drawing Sheet

CAMLESS ENGINE WITH CRANKSHAFT POSITION FEEDBACK

This application claims priority to provisional patent application Ser. No. 60/249,478, filed Nov. 13, 2000.

BACKGROUND OF THE INVENTION

The invention described in this application relates to a camless engine wherein the valves associated with each of the cylinders in an internal combustion engine are controlled electronically. Feedback is provided to control modules for each of the cylinders to provide an indication of which of two revolutions in a two-revolution cycle of the crankshaft the engine is currently in.

Internal combustion engines have historically had a number of cylinders each provided with valves for controlling the flow of air and fuel to the individual cylinders in a predetermined spaced relationship relative to the other cylinders. Further, the ignition in each of the cylinders is controlled to be in the proper sequence relative to the injection of the air and fuel.

As the ignition occurs in each cylinder a crankshaft is driven. Typically a camshaft has been provided in addition to the crankshaft, and rotates to drive the valves in the proper sequence. There are a number of cylinders, with the cylinders firing in predetermined sequence across two revolutions of the crankcase. Thus, each cylinder must have its fuel and air injected and ignition caused once per each two revolutions of the driven crankshaft. Again, a separate camshaft typically provides this timing.

More recently, camless engines have been proposed to provide simple manufacture and assembly. With camless operation a signal is provided to a control module associated with each of the cylinders to cause the valves, spark plugs, etc. to operate in the proper sequence.

However, some method of providing feedback to the control modules of which of two revolutions in a two revolution cycle of the crankcase are currently occurring is necessary.

It is known to provide a wheel on the crankshaft wherein the wheel has a plurality of timing members. The timing members typically provide some indication of when a revolution of the crankshaft has been completed. Typically, a tone wheel may be provided with a space at a particular rotation position, and the space in signals is taken by the control as an indication that a particular point has been reached. Typically, the tone wheel is provided with a plurality of members each based by approximately 6°. However, two of the members are missing such that an indication is provided when a particular point in the revolution, in typically top dead center, is reached. However, such systems have not been utilized in conjunction with camless engines to provide an indication of which of the two rotations in a two-rotation cycle of the crankshaft are currently occurring. This has been unnecessary, since the camshaft has provided the indication.

SUMMARY OF THE INVENTION

In the disclosed embodiment of this invention, a signal from a crankshaft is common for each of the two revolutions in a two-revolution cycle for the associated cylinders. The output signal from the crankshaft is processed to provide an indication of which of the two revolutions is occurring at a particular point in time. In one embodiment, the signal from the crankshaft has a location identifying components such as the two missing signals mentioned above. When this rotation identifying signal is sensed, it causes a modification in the signal that varies between the two revolutions. Thus, in one preferred embodiment the signal passes through a flip-flop that switches between a one and zero, or off and on. The output of the flip-flop adds or subtracts a signal tone to the signal from the crankcase. More preferably, the addition or subtraction occurs at the point of the break in the signal mentioned above. Thus, on one of the two revolutions there will be the prior art two spaces, whereas in the other of the two revolutions a signal element will be added (or subtracted) such that only a single space (or three) is missing. In this fashion, a control module receiving the signal will be able to identify which of the two revolutions is currently ongoing.

In other embodiments, the signal is inverted between the two revolutions, such that the control modules can identify which of the two revolutions is currently occurring. In a further embodiment a component such as a flip-flop alternatively changes the pulse width between the two revolutions, again so the individual control modules can identify which particular revolution is ongoing at any one point in time.

As could be appreciated, the control modules associated with each of the individual cylinders are programmed to know when to operate to allow flow of air, and fuel, as well as to cause firing of their individual cylinders. This occurs at a predetermined point in each of the cycles of revolution. Further, each of the cylinders preferably only operates once per two revolution cycle. The signal provided to the control modules allows each control module to identify which of the two revolutions in any one cycle is ongoing, such that the control modules can operate in a proper sequence.

These and other features of the present invention can be best understood from the following specification and drawings, the following of which is a brief description.

DETAILED DESCRIPTION OF A PREFERRED EMBODIMENT

Figure 1:
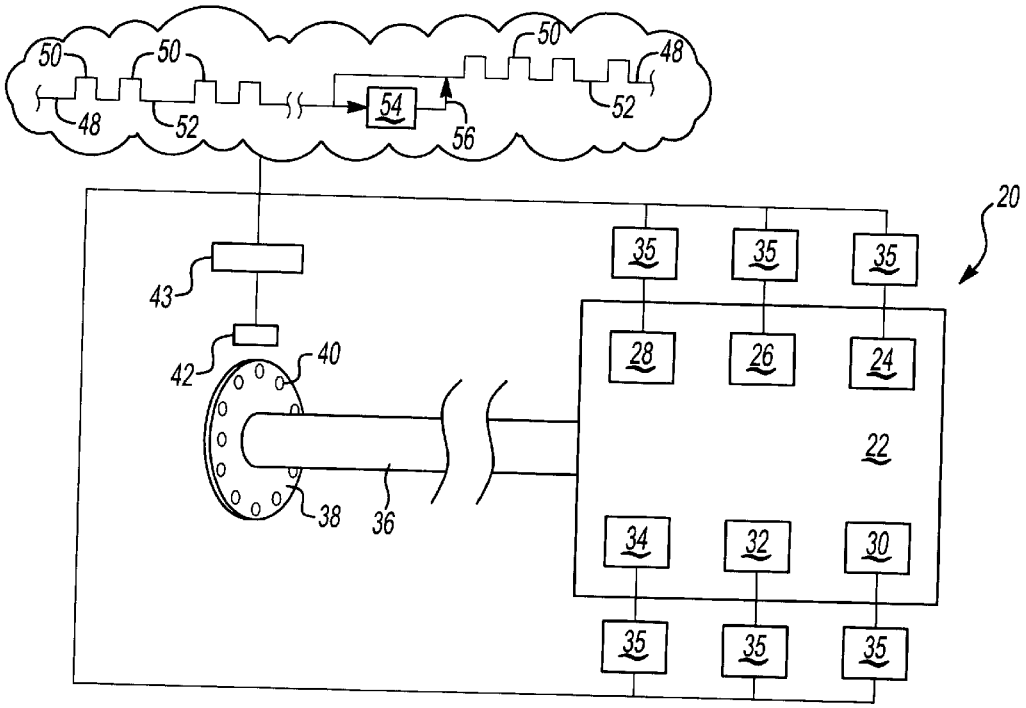
FIG. 1 schematically shows an inventive system.

A first embodiment 20 of the present invention is illustrated in FIG. 1. In this embodiment an engine 22 has a plurality of cylinders 24, 26, 28, 30, 32 and 34. Each of the cylinders is associated with a control module 35. Within each control module is an electronic control, which preferably has a microprocessor or other computer-control. The control module includes appropriate valves for causing the injection and removal of air, and the injection of fuel. Further, a spark plug and an associated ignition timer are also associated with each control module 35. As is known, pistons associated with each of the cylinders drive a crankshaft 36. The crankshaft is provided with a tone ring 38 having a plurality of elements 40 spaced around its circumference. A sensor 42 senses the passage of the elements 40, and communicates with a signal processing element 43. As is known, the tone wheel 38 preferably has some indication in its elements 40 to provide an indication of a particular point in the rotational cycle of the crankshaft 36. One known system would be to have 60 spaced elements 40 each spaced by 6° on the tone wheel 36. Two positions are not provided with an element 40. When the sensor 42 delivers signals of the elements 40 to the processor 43, the absence of two consecutive signals is indicative of a particular point in the rotational cycle of the crankshaft. As is known, the cylinders preferably operate once for each two revolutions of the crankshaft 36. As is further known, in a six cylinder engine, within each revolution there are three cylinders associated to drive the crankshaft, and each of the three cylinders are preferably spaced by 120° in the rotational cycle. However, the control modules 35 must know not only where in the rotational cycle, but also which of the two rotations of the rotational cycle of the crankshaft is currently occurring. In this fashion, each of the control modules 35 will know when to operate its associated cylinder.

The present invention provides a method for including a slight modification into the signal from the crankshaft which can be interpreted by the control module 35 to be indicative of which of two revolutions in a two-revolution cycle is currently occurring. Preferably, the system is operable on a crankshaft wherein the signal from the crankshaft is common for each of the two revolutions. The processing element 43 receives a signal from the sensor 42, wherein the signal 48 consists of a series of signals 50 each spaced by a small amount. On each revolution there is a space 52 of two missing signals, as described above. Within the signal processor 43 is preferably a switch which will switch on each occurrence of the space 52 between one of two positions. In a preferred embodiment a flip-flop switch 54 is utilized which switches between a go/no go position. Stated another way, the flip-flop switch switches between zero and one. In one of the two positions the space 52 is changed in a preferred embodiment. In one embodiment an addition of one as shown at 56 is made to the signal such that on each alternative revolution an additional signal 58 is included at the space 52. In this fashion, the control modules 35 can determine which of two revolutions is occurring. At the same time, the crankshaft delivers a common signal for each of the two revolutions.

Figure 2:
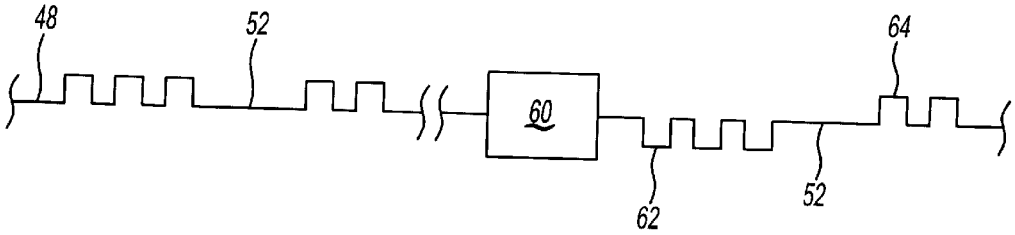
FIG. 2 shows a second embodiment of the signal processing according to this invention.

FIG. 2 shows an embodiment wherein the base signal 48 from the sensor 42 is sent to an inverter 60. The inverter 60 inverts the signal on each alternate revolution. Thus, as shown at 62, the signals are negative whereas on the subsequent revolution the signals are positive 64.

Figure 3:
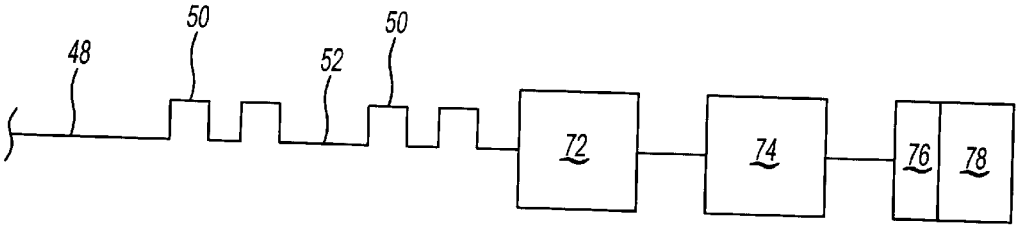
FIG. 3 shows a third embodiment of signal processing.

In yet another embodiment shown in FIG. 3, a flip-flop switch 72 operates a one shot modification element 74 to change the pulse width of the signal between a large pulse width 76 and a smaller pulse width 78 on the alternate revolution.

In each of the preferred embodiments it is still preferred that some indication of the particular point in the cycle be provided by a signal element such as space 52.

Although preferred embodiments of this invention have been disclosed, a worker in this art would recognize that certain modifications would come within the scope of this invention. For that reason the following claims should be studied to determine the true scope and content of this invention.

What is claimed is:

1. An engine control mechanism comprising:

a plurality of cylinder control modules, each being programmed to operate the flow of air and fuel and the timing of ignition for an associated cylinder at a predetermined time in one of two successful revolutions of an associated crankshaft;

an element on said crankshaft for providing an indication of a particular position in a rotational cycle of said crankshaft, and for providing an indication of when a particular point in a rotational cycle has been reached, said signal from said crankshaft being generally the same for each of said successive rotations; and a signal modifying element for modifying an output signal from said crankcase which is delivered to said control modules such that said signal from said crankcase is different for each of said two successive rotations of said crankshaft, and said signal modifying element continuing to modify said output signals for subsequent sets of two successive rotations of said crankshaft.

2. A control as recited in claim 1, wherein the crankshaft has an output signal created by a rotating wheel having a plurality of circumferentially spaced elements.

3. A control as recited in claim 2, wherein at least one of said elements is missing at one rotational position on wheel to provide an indication of when a particular point in the rotational cycle of the crankshaft has been reached.

4. An engine control mechanism comprising:

a plurality of cylinder control modules, each being programmed to operate the flow of air and fuel and the timing of ignition for an associated cylinder at a predetermined time in one of two successful revolutions of an associated crankshaft;

an element on said crankshaft for providing an indication of a particular position in a rotational cycle of said crankshaft, and for providing an indication of when a particular point in a rotational cycle has been reached, said signal from said crankshaft being generally the same for each of said successive rotations; and a signal modifying element for modifying an output signal from said crankcase which is delivered to said control modules such that said signal from said crankcase is different for each of said two successive rotations of said crankshaft;

the crankshaft has an output signal created by a rotating wheel having a plurality of circumferentially spaced elements;

at least one of said elements is missing at one rotational position on wheel to provide an indication of when a particular point in the rotational cycle of the crankshaft has been reached; and a signal from said wheel is sent through a switch which alternately shifts between one of two positions, and when in one of said two positions modifies said signal at a space where there are no signals in said signal.

5. A control as set forth in claim 4, wherein said flip-flop modifies a signal element at said space, said space being provided for the length of two of the remainder of said signals.

6. An engine control mechanism comprising:

a plurality of cylinder control modules, each being programmed to operate the flow of air and fuel and the timing of ignition for an associated cylinder at a predetermined time in one of two successful revolutions of an associated crankshaft;

an element on said crankshaft for providing an indication of a particular position in a rotational cycle of said crankshaft, and for providing an indication of when a particular point in a rotational cycle has been reached, said signal from said crankshaft being generally the same for each of said successive rotations;

a signal modifying element for modifying an output signal from said crankcase which is delivered to said control modules such that said signal from said crankcase is different for each of said two successive rotations of said crankshaft; and at least a portion of said signal of said wheel is inverted between said two successive revolutions.

7. An engine control mechanism comprising:

a plurality of cylinder control modules, each being programmed to operate the flow of air and fuel and the timing of ignition for an associated cylinder at a predetermined time in one of two successful revolutions of an associated crankshaft;

an element on said crankshaft for providing an indication of a particular position in a rotational cycle of said crankshaft, and for providing an indication of when a particular point in a rotational cycle has been reached, said signal from said crankshaft being generally the same for each of said successive rotations;

a signal modifying element for modifying an output signal from said crankcase which is delivered to said control modules such that said signal from said crankcase is different for each of said two successive rotations of said crankshaft; and the pulse width of at least a portion of said signal is varied between said two revolutions.

8. A method of providing an indication of which of two successive revolutions is occurring in a crankshaft to a plurality of control modules comprising the steps of:

1) providing a plurality of cylinders associated for driving a crankshaft, and providing each of said cylinders with a control module, said control modules being operable to control the operation of fluid valves and a ignition element, each of said control modules being programmed to control operation of an associated cylinder at a particular point in a rotational cycle of said crankshaft, and in only one of two successive revolutions;

2) monitoring rotation of said crankshaft and providing a signal from the monitoring of said crankshaft to said control modules; and 3) modifying said signal to be different for each of said two successive rotations such that said control modules have an indication of which of said two successive rotations is ongoing at a particular period of time; and 4) repeating steps 2 and 3.

9. A method as set forth in claim 8, wherein said signals are provided with a space to identify a particular point in a revolution of said crankcase, and said space is modified.

10. A method as set forth in claim 9, wherein a switch alternates between one of two positions to modify or not modify said space.

11. A method as set forth in claim 9, wherein the pulse width of the signal is modified and at least a portion of said signal between said two successive revolutions.

12. A method of providing an indication of which of two successive revolutions is occurring in a crankshaft to a plurality of control modules comprising the steps of:

1) providing a plurality of cylinders associated for driving a crankshaft, and providing each of said cylinders with a control module, said control modules being operable to control the operation of fluid valves and a ignition element, each of said control modules being programmed to control operation of an associated cylinder at a particular point in a rotational cycle of said crankshaft, and in only one of two successive revolutions;

2) monitoring rotation of said crankshaft and providing a signal from the monitoring of said crankshaft to said control modules;

3) modifying said signal to be different for each of said two successive rotations such that said control modules have an indication of which of said two successive rotations is ongoing at a particular period of time;

4) providing said signals with a space to identify a particular point in a revolution of said crankcase, and said space is modified; and 5) an inverter is operable to alternate between inverting at least a portion of said signal, or to not invert a portion of said signal.

* * * * *